US006120576A

United States Patent [19]

Toshima et al.

[11] Patent Number: 6,120,576

[45] Date of Patent: Sep. 19, 2000

[54] METHOD FOR PREPARING NICKEL FINE POWDER

[75] Inventors: Yoshiharu Toshima; Takayuki Araki; Takao Hayashi, all of Yamaguchi; Hiroyuki Shimamura, Tokyo, all of Japan

[73] Assignee: Mitsui Mining and Smelting Co., Ltd., Tokyo, Japan

[21] Appl. No.: 09/112,361

[22] Filed: Jul. 9, 1998

[30] Foreign Application Priority Data

Sep. 11, 1997 [JP] Japan ..... 9-247125

[51] Int. Cl.[7] ..... B22F 9/24

[52] U.S. Cl. ..... 75/370; 75/374

[58] Field of Search ..... 75/370, 371, 374

[56] References Cited

U.S. PATENT DOCUMENTS

| | | | |
|---|---|---|---|
| 3,850,612 | 11/1974 | Montino et al. | 75/370 |
| 4,089,676 | 5/1978 | Grundy | 75/374 |

FOREIGN PATENT DOCUMENTS

| | | | |
|---|---|---|---|
| 0 649 818 | 4/1995 | European Pat. Off. . | |
| 58-096802 | 6/1983 | Japan | 75/374 |
| 5-51610 | 3/1993 | Japan | 75/374 |
| 7-207307 | 8/1995 | Japan . | |
| 7-278619 | 10/1995 | Japan . | |
| 8-246001 | 9/1996 | Japan . | |

OTHER PUBLICATIONS

Jis K 1202, "Solid Caustic Soda", 1981, Reaffirmed 1986 (With Translation).

Jis K 1203, "Liquid Caustic Soda", 1981, Reaffirmed 1986 (With Translation).

Jis K 8576, "Sodium Hydroxide", 1989, (With Translation).

*Primary Examiner*—George Wyszomierski
*Attorney, Agent, or Firm*—Young & Thompson

[57] ABSTRACT

A method for preparing nickel fine powder is herein disclosed, which comprises the steps of mixing an aqueous sodium hydroxide solution comprising, on the basis of the total weight of the sodium hydroxide present in the aqueous solution, 75 to 85% by weight of liquid caustic soda as specified in JIS K 1203 and 25 to 15% by weight, in total, of at least one of sodium hydroxide as specified in JIS K 8576 and solid caustic soda as specified in JIS K 1202, with an aqueous solution of nickel sulfate to form nickel hydroxide, then reducing the resulting nickel hydroxide with hydrazine and recovering nickel fine powder produced. The nickel fine powder prepared by the method has an average particle size of the primary particles ranging from 0.1 to 0.9 $\mu$m, a $D_{90}$ value of not more than 2.1 $\mu$m and a tap density of not less than 3.5 g/cc. The nickel fine powder has a low degree of aggregation, a narrow particle size distribution and a high tap density and therefore, the powder is quite suitably used as a material for producing an internal electrode for a laminated ceramic condenser.

19 Claims, 1 Drawing Sheet

METHOD FOR PREPARING NICKEL FINE POWDER

BACKGROUND OF THE INVENTION (a) Field of the Invention

The present invention relates to a method for preparing nickel fine powder and more specifically to a method for preparing nickel fine powder, which is principally suitable for use as a material for an internal electrode of laminated ceramic condensers, whose particle size distribution is sharp and which has a low degree of agglomeration and a paste containing the nickel fine powder is excellent in filling properties.

(b) Description of the Prior Art

The laminated ceramic condenser is a condenser produced by alternately putting ceramic dielectric materials and internal electrodes into layers, followed by bonding these layers under press and firing the resulting assembly to thus unite the layers with each other. On the other hand, techniques have been developed and advanced, in which a base metal such as Ni is used instead of noble metals such as Pt and Pd conventionally used as materials for such internal electrodes.

There have also been proposed a variety of methods for preparing the material, i.e., nickel powder along with the development and/or advancement of such techniques. A typical method for preparing the same includes a dry method such as a gas phase reduction of nickel chloride vapor with hydrogen as disclosed in Japanese Un-Examined Patent Publication (hereinafter referred to as "J.P. KOKAI") No. Hei 8-246001, but the wet method which comprises reducing a nickel ion-containing aqueous solution with a reducing agent under specific conditions to thus separate out nickel has many advantages including economical one from the viewpoint of the energy cost or the like.

As representatives of the wet methods, there may be listed those disclosed in J.P. KOKAI Nos. Hei 7-207307 and Hei 7-278619. The former discloses a method which comprises the steps of mixing an aqueous solution containing hydroxyl ions and ammonium ions with an aqueous solution of a water-soluble nickel (II) salt to form an ammonia-nickel complex and then adding a reducing agent to the ammonia-nickel complex to thus reduce the complex. On the other hand, the latter discloses a method which comprises the steps of adding a strong alkali to a nickel salt aqueous solution having a specific concentration, adjusting the temperature and pH of the mixture to specific values, treating it with a reducing agent having specific temperature and concentration and finishing the reaction within a specific reaction time. These patents disclose, as to the resulting nickel powder, that the primary particle size ranges from 0.3 to 1.2 $\mu$m for the former and 0.4 to 0.6 $\mu$m for the latter and that the widths of the particle size distribution thereof are identical or superior to those observed for the conventional products.

The powder prepared by the foregoing methods have a particle size falling within a certain range of the particle size distribution, but the powder prepared by the method disclosed in J.P. KOKAI No. Hei 7-207307 has a $D_{90}$ value ranging from about 2.13 to 3.88 $\mu$m as described in Table 2 on page 4 of the specification and that prepared by the method disclosed in J.P. KOKAI No. Hei 7-278619 has a $D_{90}$ value ranging from about 2.58 to 2.87 $\mu$m as described in Table 2 on page 3 of the specification. This clearly indicates that the foregoing methods are insufficient for preparing a powdery product which has a lesser extent of agglomeration, i.e., which has a small $D_{90}$ value.

SUMMARY OF THE INVENTION

Accordingly, an object of the present invention is to provide a method for preparing nickel fine powder which is suitable for use as a material for internal electrodes of laminated ceramic condensers, whose primary particles have an average particle size ranging from about 0.1 to 0.9 $\mu$m, which has a low degree of agglomeration and a narrow width of the particle size distribution and which has a high tap density.

To produce nickel powder having a narrow particle size distribution and a high tap density while controlling the average particle size of the primary particles, it would be necessary to take, into consideration, various condition of productions in the step for nickel hydroxide-generation and the step for reducing reaction such as concentrations and temperatures of solutions used, reaction temperatures, times required for the addition (or mixing) of the solutions and stirring conditions. Such condition of productions are of course important factors to obtain excellent nickel fine powder, but it would be difficult to achieve the desired purpose by simply controlling these condition of productions. This fact is also clear from the characteristic properties of the nickel powder described in the prior art listed above.

The inventors of this invention have conducted various investigations to achieve the foregoing object, have found that, in the method for preparing nickel powder by mixing an aqueous solution of sodium hydroxide and an aqueous solution of nickel sulfate to give nickel hydroxide and then reducing the nickel hydroxide, the average particle size of the primary particles, degree of agglomeration, width of the particle size distribution and tap density of the finally produced nickel powder are largely affected by the presence of trace amounts of impurities in the sodium hydroxide aqueous solution, that the control of the concentrations of the trace impurities permits the production of nickel fine powder having a specific average particle size of the primary particles, a low degree of agglomeration and a narrow particle size distribution and a high tap density and that it is convenient to use a combination of the liquid caustic soda specified in JIS K 1203 and at least one of the sodium hydroxide specified in JIS K 8576 and the solid caustic soda defined in JIS K 1202 in order to control the concentrations of the trace impurities, and thus have completed the present invention based on these findings.

Thus, the method for preparing the nickel fine powder according to the present invention comprises the steps of mixing an aqueous sodium hydroxide solution which comprises, on the basis of the total weight of sodium hydroxide present in the aqueous solution, 75 to 85% by weight of liquid caustic soda as specified in JIS K 1203 and 25 to 15% by weight of at least one of sodium hydroxide as specified in JIS K 8576 and solid caustic soda as specified in JIS K 1202, with an aqueous solution of nickel sulfate to form nickel hydroxide, then reducing the resulting nickel hydroxide with hydrazine and recovering nickel produced.

BRIEF DESCRIPTION OF THE DRAWINGS

The present invention will become more apparent from the following detailed description of the invention and the accompanying drawings, wherein.

DESCRIPTION OF THE PREFERRED EMBODIMENTS

Figure 1:
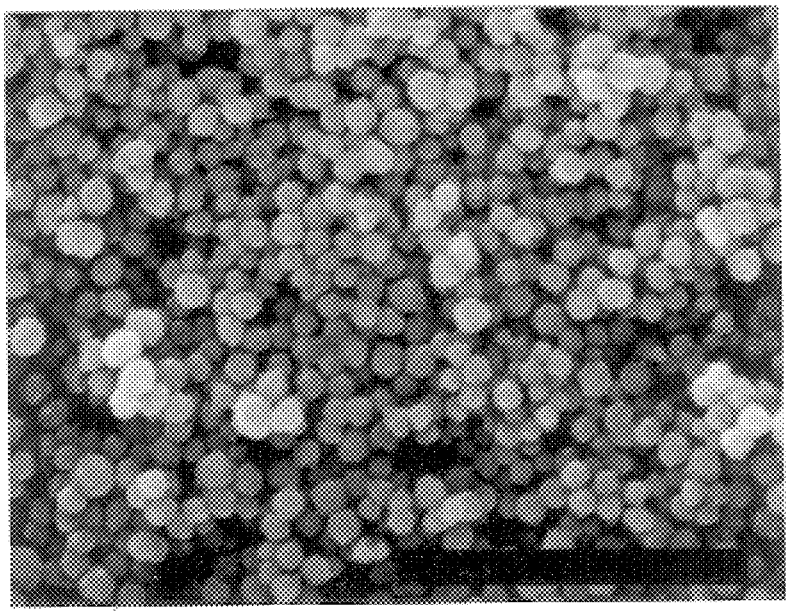
FIG. 1 is a micrograph (SEM) showing the nickel fine powder prepared in Example 2.

In the method of the present invention, the reason why the method permits the production of nickel fine powder having a low degree of agglomeration, a narrow particle size distribution and a high tap density while controlling the average particle size of the primary particles and the mechanism thereof have not yet been clearly elucidated.

However, the foregoing three kinds of sodium hydroxide sources used in the present invention contain cations such as $Fe^{3+}$, $Ca^{2+}$ and $Al^{3+}$ and anions such as $CO_3^{2-}$ and $Cl^-$ in different concentrations, respectively and it would be assumed that these cations greatly affect the nucleation during the nickel hydroxide-generation reaction and during the reducing reaction, while these anions each greatly affects the reaction rates.

The characteristic properties (specifications) of the sodium hydroxide specified in JIS K 8576 and used in the present invention are as follows:

| | |
|---|---|
| Purity | not less than 96.0% |
| Chloride (Cl) Content | not more than 0.005% |
| Phosphate ($PO_4$) Content | not more than 0.001% |
| Silicate (expressed in terms of the amount of $SiO_2$) Content | not more than 0.01% |
| Sulfate ($SO_4$) Content | not more than 0.002% |
| Nitrogen-Containing Compound (expressed in terms of the amount of N) Content | not more than 0.001% |
| Potassium (K) Content | not more than 0.05% |
| Magnesium (Mg) Content | not more than 5 ppm |
| Calcium (Ca) Content | not more than 0.002% |
| Zinc (Zn) Content | not more than 0.001% |
| Aluminum (Al) Content | not more than 0.002% |
| Lead (Pb) Content | not more than 5 ppm |
| Iron (Fe) Content | not more than 5 ppm |
| Nickel (Ni) Content | not more than 0.001% |
| Sodium Carbonate ($Na_2CO_3$) Content | not more than 1.5% |

The characteristic properties of the solid caustic soda Nos. 1 to 4 specified in JIS K 1202 and used in the present invention will be listed in the following Table:

| Content (%) | No. 1 | No. 2 | No. 3 | No. 4 |
|---|---|---|---|---|
| Sodium hydroxide (NaOH) | ≧98 | ≧97 | ≧96 | ≧94 |
| Sodium Carbonate ($Na_2CO_3$) | ≦2 | ≦2 | ≦2 | ≦2 |
| Sodium Chloride (NaCl) | ≦0.15 | ≦1.0 | ≦2.8 | ≦3.2 |
| Ferric Oxide ($Fe_2O_3$) | ≦0.005 | ≦0.005 | ≦0.008 | ≦0.008 |

The characteristic properties of the liquid caustic soda Nos. 1 to 4 specified in JIS K 1203 and used in the present invention are as follows:

The properties of the liquid caustic soda having a sodium hydroxide (NaOH) content of 45% are as follows:

| Content (%) | No. 1 | No. 2 | No. 3 | No. 4 |
|---|---|---|---|---|
| Sodium Carbonate ($Na_2CO_3$) | ≦1 | ≦1 | ≦1 | ≦1 |
| Sodium Chloride (NaCl) | ≦0.1 | ≦0.5 | ≦1.3 | ≦1.6 |
| Ferric Oxide ($Fe_2O_3$) | ≦0.005 | ≦0.01 | ≦0.02 | ≦0.03 |

The properties of the liquid caustic soda except for that having a sodium hydroxide (NaOH) content of 45% are not more than the values each of which is in proportion to that calculated on the basis of the corresponding value listed in the foregoing Table.

For this reason, it would be recognized that the control of the concentrations of ions, which may be referred to as impurities, consequently permits the control of characteristic properties of the nickel powder produced.

For instance, when only the liquid caustic soda specified in JIS K 1203 is used as a sodium hydroxide source while laying stress on the economical aspect, the concentrations of impurity ions included therein are high and widely vary, the number of relatively large nuclei increases at each time the reaction is carried out, the amount of nuclei widely varies and simultaneously the reaction rate also varies widely, the average particle size of the primary particles constituting the final nickel powder is rather large and the size is liable to be non-uniform.

On the other hand, when only the sodium hydroxide specified in JIS K 8576 or the solid caustic soda defined in JIS K 1202 is used as a sodium hydroxide source in order to improve characteristic properties, in particular, the particle size distribution of the nickel powder, the source has a low impurity content, this results in the formation of rather fine nuclei and a stable reaction rate can be ensured. Therefore, the resulting nickel powder comprises primary particles having a small average particle size and has a narrow particle size distribution. However, the use of these sodium hydroxide sources is unfavorable from the economical standpoint and does not permit the production of nickel powder comprising primary particles having a relatively large average particle size.

The inventors have grasped such a tendency and have found that desired nickel powder can be obtained by using an aqueous solution comprising a combination of the liquid caustic soda specified in JIS K 1203 with at least one of the sodium hydroxide specified in JIS K 8576 and the solid caustic soda defined in JIS K 1202, as a sodium hydroxide source, while limiting the effect of impurity ions to a low level and taking the economical advantages into consideration.

In a first embodiment of the present invention, there is used an aqueous solution of sodium hydroxide which comprises, on the basis of the total sodium hydroxide present in the solution, 75 to 85% by weight of the liquid caustic soda specified in JIS K 1203 and 25 to 15% by weight of the sodium hydroxide specified in JIS K 8576. In this case, the resulting nickel powder is constituted by primary particles having an average particle size ranging from about 0.1 to 0.3 $\mu$m.

In this first embodiment, if the rate of the liquid caustic soda specified in JIS K 1203 is less than 75% by weight on the basis of the total weight of the sodium hydroxide present in the aqueous solution or the rate of the sodium hydroxide specified in JIS K 8576 present in the sodium hydroxide aqueous solution exceeds 25% by weight, the impurity ion concentration of the resulting sodium hydroxide aqueous solution is too low to obtain nickel powder whose primary particles have an average particle size of not less than 0.1 $\mu$m and which has a low degree of agglomeration and the use of such a sodium hydroxide solution is economically unfavorable. On the other hand, if the rate of the liquid caustic soda specified in JIS K 1203 exceeds 85% by weight on the basis of the total weight of the sodium hydroxide present in the aqueous solution or the rate of the sodium hydroxide specified in JIS K 8576 present in the sodium hydroxide aqueous solution is less than 15% by weight, the impurity ion concentration of the resulting sodium hydroxide aqueous solution is extremely high, the reaction rate accordingly becomes unstable and as a result, there are observed various bad effects. For instance, the resulting nickel powder has wide width of the particle size distribution and a low tap density.

In a second embodiment of the present invention, there is used an aqueous solution of sodium hydroxide which comprises, on the basis of the total sodium hydroxide present in the solution, 75 to 85% by weight of a liquid caustic soda specified in JIS K 1203 and 25 to 15% by weight of the solid caustic soda defined in JIS K 1202. In this case, the resulting nickel powder is constituted by primary particles having an average particle size ranging from about 0.7 to 0.9 $\mu$m.

In this second embodiment, if the rate of the liquid caustic soda specified in JIS K 1203 is less than 75% by weight on the basis of the total weight of the sodium hydroxide present in the aqueous solution or the rate of the solid caustic soda defined in JIS K 1202 present in the sodium hydroxide aqueous solution exceeds 25% by weight, the impurity ion concentration of the resulting sodium hydroxide aqueous solution is too low to obtain nickel powder whose primary particles have a large average particle size and which has a low degree of agglomeration and the use of such a sodium hydroxide solution is economically unfavorable. On the other hand, if the rate of the liquid caustic soda specified in JIS K 1203 exceeds 85% by weight on the basis of the total weight of the sodium hydroxide present in the aqueous solution or the rate of the solid caustic soda defined in JIS K 1202 present in the sodium hydroxide aqueous solution is less than 15% by weight, the impurity ion concentration of the resulting sodium hydroxide aqueous solution is extremely high, the average particle size of the primary particles constituting the resulting nickel powder exceeds 0.9 μm, the reaction rate becomes unstable and as a result, there are observed various bad effects. For instance, the resulting nickel powder has wide width of the particle size distribution and a low tap density.

According to a third embodiment of the present invention, there is used an aqueous solution of sodium hydroxide which comprises a liquid caustic soda specified in JIS K 1203 in an amount ranging from 75 to 85% by weight on the basis of the total sodium hydroxide in the solution and the sodium hydroxide specified in JIS K 8576 and the solid caustic soda defined in JIS K 1202 in an amount ranging from 25 to 15% by weight, in total, on the basis of the total sodium hydroxide in the solution. In this case, the resulting nickel powder is constituted by primary particles having an average particle size ranging from about 0.1 to 0.9 μm.

In this third embodiment, if the rate of the liquid caustic soda specified in JIS K 1203 is less than 75% by weight on the basis of the total weight of the sodium hydroxide present in the aqueous solution or the sum of the amounts of the sodium hydroxide specified in JIS K 8576 and the solid caustic soda defined in JIS K 1202 present in the sodium hydroxide aqueous solution exceeds 25% by weight, the impurity ion concentration of the resulting sodium hydroxide aqueous solution is too low to obtain nickel powder whose primary particles have an average particle size of not less than 0.1 μm and which has a low degree of agglomeration and the use of such a sodium hydroxide solution is economically unfavorable. On the other hand, if the rate of the liquid caustic soda specified in JIS K 1203 exceeds 85% by weight on the basis of the total weight of the sodium hydroxide present in the aqueous solution or the sum of the amounts of the sodium hydroxide specified in JIS K 8576 and the solid caustic soda defined in JIS K 1202 present in the sodium hydroxide aqueous solution is less than 15% by weight, the impurity ion concentration of the resulting sodium hydroxide aqueous solution is extremely high, the average particle size of the primary particles constituting the nickel powder ultimately obtained exceeds 0.9 μm, the reaction rate becomes unstable and as a result, there are observed various bad effects. For instance, the resulting nickel powder has wide width of the particle size distribution and a low tap density.

Conditions for the nickel hydroxide-generation step and the reducing reaction step are also important in the production method of the present invention.

First, the nickel hydroxide-generation step will be detailed below. The mixing ratio of the sodium hydroxide aqueous solution to the nickel sulfate aqueous solution preferably ranges from 1.66 to 1.84:1 and more preferably 1.70 to 1.80:1 as expressed in terms of the chemical equivalent ratio, i.e., sodium hydroxide: nickel sulfate. If the mixing ratio is less than 1.66:1 (the relative amount of sodium hydroxide is small), there are observed such tendencies that it takes a long time period to form nickel hydroxide and that it is difficult to obtain nickel powder whose primary particles have a desired average particle size and a sharp width of the particle size distribution. On the other hand, if the mixing ratio exceeds 1.84:1, any effect compensating an increase in cost cannot be expected.

When mixing the aqueous sodium hydroxide solution with the aqueous solution of nickel sulfate, these aqueous solutions may be admixed at a time. In this case, however, the mixing procedure is liable to form a jelly-like mixture and this makes the post-treatments quite troublesome. For this reason, it is preferred to gradually add the aqueous solution of sodium hydroxide to the aqueous nickel sulfate solution or vice versa.

Then the reducing reaction step will be discussed below in detail. The mixing ratio of nickel hydroxide to hydrazine preferably ranges from 1:9.5 to 10.5 and more preferably 1:9.7 to 10.3 as expressed in terms of the chemical equivalent ratio, i.e., nickel hydroxide : hydrazine. If the mixing ratio is more than 1:9.50 (the relative amount of hydrazine is small), there are observed such tendencies that this would interfere with the reducing reaction and that the width of the particle size distribution of the primary particles constituting the nickel powder finally obtained is wide. On the other hand, the mixing ratio is less than 1:10.50, there are observed such tendencies that the reaction rapidly proceeds, the average particle size of the primary particles correspondingly becomes small and that any effect compensating an increase in cost cannot be expected.

Regarding the temperature conditions, the nickel hydroxide-generation step and the reducing reaction step are preferably carried out at a temperature ranging from 55 to 70° C. and more preferably 55 to 65° C. This is because if the temperature is less than 55° C., this interferes with the progress of each reaction and accordingly, there are observed such tendencies that it is difficult to obtain nickel powder whose primary particles have a desired average particle size and that the width of the particle size distribution of the primary particles is wide. On the other hand, if it exceeds 70° C., any effect compensating an increase in cost cannot be expected.

As has been described above in detail, the method of the present invention permits the production of desired nickel fine powder whose primary particles have an average particle size ranging from 0.1 to 0.9 μm and a tap density of not less than 3.5 g/cc. The average particle size falling within the range defined above would ensure the $D_{90}$ value of not more than 2.1 μm irrespective of the average particle size of the primary particles. The nickel fine powder is quite suitable for use as a material for the production of an internal electrode for a laminated ceramic condenser.

The present invention will hereinafter be described with reference to the following Examples, but the present invention is not limited to these specific Examples.

EXAMPLE 1

The sodium hydroxide (108 g; NaOH grade: 97%) specified in JIS K 8576 was dissolved in 1728 g of an aqueous solution prepared by diluting the liquid caustic soda (NaOH concentration: 45% by weight) specified in JIS K 1203 with pure water to a concentration of 25% by weight to give an aqueous solution having a sodium hydroxide concentration of 13.5 mol/l.

To one liter of the foregoing sodium hydroxide aqueous solution, there was continuously added 2.27 liters of a 1.7 mol/l aqueous solution prepared by dissolving nickel sulfate ($NiSO_4.6H_2O$; $NiSO_4$ grade: 22.2% by weight) in pure water, over 50 minutes while maintaining the temperature of the aqueous solution to 60° C. to give a nickel hydroxide slurry.

To the resulting nickel hydroxide slurry, there was added, at a time, 0.96 liter of water-containing hydrazine having a concentration of 20 mol/l while stirring the reaction system and maintaining the temperature of the aqueous solution to 60° C. to form nickel fine particles. The resulting nickel fine particles were sufficiently washed with pure water, followed by filtration, drying and classification treatments according to the usual manner to thus give nickel fine powder.

EXAMPLE 2

The same procedures used in Example 1 were repeated except for the preparation of a 13.5 mol/l sodium hydroxide aqueous solution by dissolving 76 g of the sodium hydroxide (NaOH grade: 97%) specified in JIS K 8576 and 32 g of the solid caustic soda (NaOH grade: 96%) specified in JIS K 1202 in 1728 g of the aqueous solution prepared by diluting the liquid caustic soda (NaOH concentration: 45% by weight) specified in JIS K 1203 with pure water to a concentration of 25% by weight and the use of one liter of the resulting sodium hydroxide aqueous solution, to thus give nickel fine powder.

EXAMPLE 3

The same procedures used in Example 1 were repeated except for the preparation of a 13.5 mol/l sodium hydroxide aqueous solution by dissolving 108 g of the solid caustic soda (NaOH grade: 96%) specified in JIS K 1202 in 1728 g of the aqueous solution prepared by diluting the liquid caustic soda (NaOH concentration: 45% by weight) specified in JIS K 1203 with pure water to a concentration of 25% by weight and the use of one liter of the resulting sodium hydroxide aqueous solution, to thus give nickel fine powder.

Comparative Example 1

Nickel fine powder was prepared by repeating the same procedures, under the same conditions, used in Example 1 except for the use of one liter of a 13.5 mol/l sodium hydroxide aqueous solution prepared by diluting the liquid caustic soda (NaOH concentration: 45% by weight) specified in JIS K 1203 with pure water.

Comparative Example 2

Nickel fine powder was prepared by repeating the same procedures, under the same conditions, used in Example 1 except for the use of one liter of a 13.5 mol/l sodium hydroxide aqueous solution prepared by diluting the sodium hydroxide (NaOH grade: 97%) specified in JIS K 8576 with pure water.

Comparative Example 3

Nickel fine powder was prepared by repeating the same procedures, under the same conditions, used in Example 1 except for the use of one liter of a 13.5 mol/l sodium hydroxide aqueous solution prepared by diluting the solid caustic soda (NaOH grade: 96%) specified in JIS K 1202 with pure water.

Comparative Example 4

Nickel fine powder was prepared by repeating the same procedures, under the same conditions, used in Example 1 except for the preparation of a 13.5 mol/l sodium hydroxide aqueous solution by dissolving 162 g of the sodium hydroxide (NaOH grade: 97%) specified in JIS K 8576 in 1512 g of the aqueous solution prepared by diluting the liquid caustic soda (NaOH concentration: 45% by weight) specified in JIS K 1203 with pure water to a concentration of 25% by weight and the use of one liter of the resulting sodium hydroxide aqueous solution.

Comparative Example 5

Nickel fine powder was prepared by repeating the same procedures, under the same conditions, used in Example 1 except for the preparation of a 13.5 mol/l sodium hydroxide aqueous solution by dissolving 162 g of the solid caustic soda (NaOH grade: 96%) specified in JIS K 1202 in 1512 g of the aqueous solution prepared by diluting the liquid caustic soda (NaOH concentration: 45% by weight) specified in JIS K 1203 with pure water to a concentration of 25% by weight and the use of one liter of the resulting sodium hydroxide aqueous solution.

Comparative Example 6

Nickel fine powder was prepared by repeating the same procedures, under the same conditions, used in Example 1 except for the preparation of a 13.5 mol/l sodium hydroxide aqueous solution by dissolving 38 g of the sodium hydroxide (NaOH grade: 97%) specified in JIS K 8576 and 16 g of the solid caustic soda (NaOH grade: 96%) specified in JIS K 1202 in 1944 g of the aqueous solution prepared by diluting the liquid caustic soda (NaOH concentration: 45% by weight) specified in JIS K 1203 with pure water to a concentration of 25% by weight and the use of one liter of the resulting sodium hydroxide aqueous solution.

Figure 2:
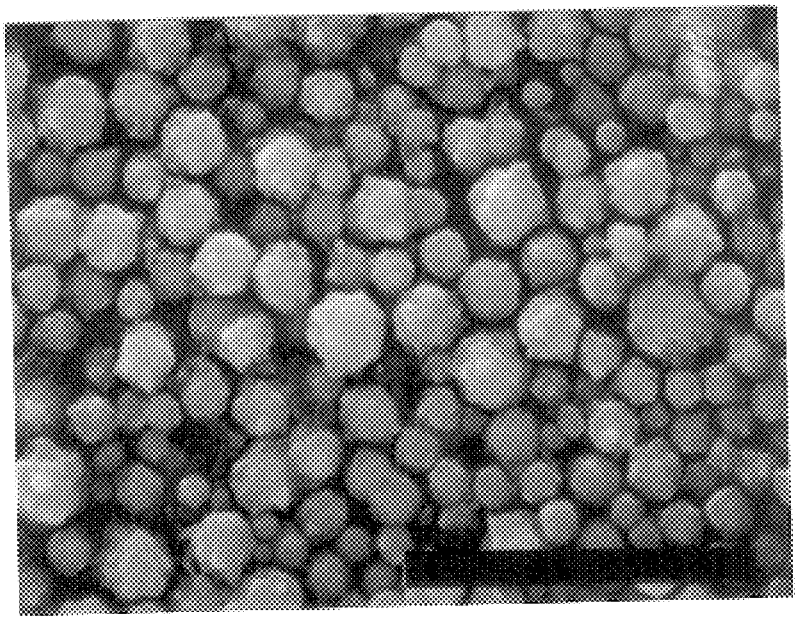
FIG. 2 is a micrograph (SEM) showing the nickel fine powder prepared in Comparative Example 5.

Determination of Characteristic Properties of Nickel Fine Powder and SEM Microscopic Observation Thereof The samples of the nickel fine powder prepared in the foregoing Examples 1 to 3 and Comparative Examples 1 to 6 were subjected to electron microscopic observation (SEM), followed by determination of the Felet diameter (average particle size of the primary particles) on the basis of the microscopic observation, determination of the $D_{90}$ value according to the microtracking technique and determination of the tap density using a tap denser. The values thus determined are summarized in the following Table 1. In addition, the SEM micrograph (8000×magnification) of the nickel fine powder prepared in Example 2 is shown in FIG. 1 and that (8000×magnification) observed for the powder prepared in Comparative Example 5 is shown in FIG. 2.

TABLE 1

| Ex. No. | Average Particle Size, μm | Particle Size Distribution $D_{90}$ Value, μm | Tap Density g/cc |
|---|---|---|---|
| 1 | 0.2 | 1.75 | 3.54 |
| 2 | 0.5 | 1.98 | 3.96 |
| 3 | 0.8 | 2.09 | 4.22 |
| 1 * | 1.0 | 2.85 | 3.38 |
| 2 * | 0.15 | 4.53 | 2.50 |
| 3 * | 0.3 | 3.79 | 3.98 |
| 4 * | 0.15 | 2.54 | 2.73 |
| 5 * | 0.7 | 3.36 | 3.87 |
| 6 * | 0.8 | 3.62 | 3.15 |

*: Comparative Example

As will be clear from the data listed in Table 1, the nickel fine powder prepared in Examples 1 to 3 according to the present invention have an average particle size, of the primary particles, ranging from 0.2 to 0.8 μm, a $D_{90}$ value of not more than 2.1 μm and a tap density of not less than 3.5 g/cc. Moreover, the nickel fine powder of the invention has a low degree of agglomeration and a narrow particle size distribution as seen from the SEM micrographs shown in FIGS. 1 and 2.

On the other hand, the nickel fine powder prepared in Comparative Examples 1 to 6 have a $D_{90}$ value of greater than 2.1 μm and a tap density of less than 3.5 g/cc.

As has been discussed above in detail, the nickel fine powder prepared by the method according to the present invention has an average particle size of the primary particles ranging from 0.1 to 0.9 μm, a $D_{90}$ value of not more than 2.1 μm and a tap density of not less than 3.5 g/cc. In other words, the powder has a low degree of agglomeration, a narrow particle size distribution and a high tap density and therefore, the powder of the invention is quite suitable for use as a material for producing an internal electrode for a laminated ceramic condenser.

What is claimed is:

1. A method for preparing nickel fine powder comprising the steps of mixing an aqueous sodium hydroxide solution which comprises, on the basis of the total weight of the sodium hydroxide present in the aqueous solution, 75 to 85% by weight of liquid caustic soda as specified in JIS K 1203 and 25 to 15% by weight, in total, of at least one of sodium hydroxide as specified in JIS K 8576 and solid caustic soda as specified in JIS K 1202, with an aqueous solution of nickel sulfate to form nickel hydroxide, then reducing the resulting nickel hydroxide with hydrazine and recovering nickel produced.

2. The method according to claim 1 wherein the aqueous sodium hydroxide solution comprises, on the basis of the total weight of the sodium hydroxide present in the aqueous solution, 75 to 85% by weight of liquid caustic soda as specified in JIS K 1203 and 25 to 15% by weight of sodium hydroxide as specified in JIS K 8576.

3. The method according to claim 1 wherein the aqueous sodium hydroxide solution comprises, on the basis of the total weight of the sodium hydroxide present in the aqueous solution, 75 to 85% by weight of liquid caustic soda as specified in JIS K 1203 and 25 to 15% by weight of solid caustic soda as specified in JIS K 1202.

4. The method according to claim 1 wherein the aqueous sodium hydroxide solution comprises, on the basis of the total weight of the sodium hydroxide present in the aqueous solution, 75 to 85% by weight of liquid caustic soda as specified in JIS K 1203 and 25 to 15% by weight, in total, of sodium hydroxide as specified in JIS K 8576 and solid caustic soda as specified in JIS K 1202.

5. The method according to claim 1 wherein the mixing ratio of the aqueous sodium hydroxide solution to the aqueous nickel sulfate solution ranges from 1.66 to 1.84:1, as expressed in terms of a chemical equivalent ratio, sodium hydroxide: nickel sulfate.

6. The method according to claims 5 wherein, when mixing the aqueous sodium hydroxide solution with the aqueous nickel sulfate solution, one is gradually added to the other.

7. The method according to claim 6 wherein the mixing ratio of the nickel hydroxide to hydrazine in the reducing step ranges from 1:9.5 to 10.5, as expressed in terms of a chemical equivalent ratio, nickel hydroxide: hydrazine.

8. The method according to claim 7 wherein the method produces nickel fine powder whose primary particles have an average particle size ranging from 0.1 to 0.9 μm and which has a $D_{90}$ value of not more than 2.1 μm and a tap density of not less than 3.5 g/cc.

9. The method according to claim 6 wherein the method produces nickel fine powder whose primary particles have an average particle size ranging from 0.1 to 0.9 μm and which has a $D_{90}$ value of not more than 2.1 μm and a tap density of not less than 3.5 g/cc.

10. The method according to claim 5 wherein the mixing ratio of the nickel hydroxide to hydrazine in the reducing step ranges from 1:9.5 to 10.5, as expressed in terms of a chemical equivalent ratio, nickel hydroxide: hydrazine.

11. The method according to claim 10 wherein the method produces nickel fine powder whose primary particles have an average particle size ranging from 0.1 to 0.9 μm and which has a $D_{90}$ value of not more than 2.1 μm and a tap density of not less than 3.5 g/cc.

12. The method according to claim 5 wherein the method produces nickel fine powder whose primary particles have an average particle size ranging from 0.1 to 0.9 μm and which has a $D_{90}$ value of not more than 2.1 μm and a tap density of not less than 3.5 g/cc.

13. The method according to claim 1 wherein, when mixing the aqueous sodium hydroxide solution with the aqueous nickel sulfate solution, one is gradually added to the other.

14. The method according to claim 13 wherein the mixing ratio of the nickel hydroxide to hydrazine in the reducing step ranges from 1:9.5 to 10.5, as expressed in terms of a chemical equivalent ratio, nickel hydroxide: hydrazine.

15. The method according to claim 14 wherein the method produces nickel fine powder whose primary particles have an average particle size ranging from 0.1 to 0.9 μm and which has a $D_{90}$ value of not more than 2.1 μm and a tap density of not less than 3.5 g/cc.

16. The method according to claim 13 wherein the method produces nickel fine powder whose primary particles have an average particle size ranging from 0.1 to 0.9 μm and which has a $D_{90}$ value of not more than 2.1 μm and a tap density of not less than 3.5 g/cc.

17. The method according to claim 1 wherein the mixing ratio of the nickel hydroxide to hydrazine in the reducing step ranges from 1:9.5 to 10.5, as expressed in terms of a chemical equivalent ratio, nickel hydroxide: hydrazine.

18. The method according to claim 17 wherein the method produces nickel fine powder whose primary particles have an average particle size ranging from 0.1 to 0.9 μm and which has a $D_{90}$ value of not more than 2.1 μm and a tap density of not less than 3.5 g/cc.

19. The method according to claim 1 wherein the method produces nickel fine powder whose primary particles have an average particle size ranging from 0.1 to 0.9 μm and which has a $D_{90}$ value of not more than 2.1 μm and a tap density of not less than 3.5 g/cc.

* * * * *